US010077408B1

(12) United States Patent
Mick

(10) Patent No.: US 10,077,408 B1
(45) Date of Patent: Sep. 18, 2018

(54) FIRE ENHANCEMENT DEVICE

(71) Applicant: MickWick, LLC, Spokane, WA (US)

(72) Inventor: Patrick Mick, Spokane, WA (US)

(73) Assignee: MickWick, LLC, Spokane, WA (US)

( * ) Notice: Subject to any disclaimer, the term of this patent is extended or adjusted under 35 U.S.C. 154(b) by 0 days.

(21) Appl. No.: 15/799,944

(22) Filed: Oct. 31, 2017

(51) Int. Cl.
*C10L 11/00* (2006.01)
*C10L 11/04* (2006.01)

(52) U.S. Cl.
CPC ..... *C10L 11/04* (2013.01); *C10L 2290/06* (2013.01); *C10L 2290/30* (2013.01); *C10L 2290/32* (2013.01)

(58) Field of Classification Search
CPC .. C10L 11/04; C10L 2290/30; C10L 2290/06; C10L 2290/32
See application file for complete search history.

(56) References Cited

U.S. PATENT DOCUMENTS 3,844,706 A * 10/1974 Tsaras ..... C11C 5/002 431/288
4,326,854 A * 4/1982 Tanner ..... C10L 5/105 44/567
4,875,905 A * 10/1989 Somerville ..... C10L 5/40 44/589
5,728,192 A * 3/1998 Andrew, Jr. ..... C05F 7/00 71/26
5,830,548 A * 11/1998 Andersen ..... B28B 1/00 428/36.4
9,410,696 B2 * 8/2016 Decker ..... F23D 3/08
9,932,537 B2 * 4/2018 Schunk ..... C10L 11/04
9,945,052 B2 * 4/2018 Holt ..... B02B 3/10
2002/0013444 A1 * 1/2002 Jones ..... A61K 8/042 528/170
2002/0151622 A1 * 10/2002 Tock ..... C08L 101/00 524/27
2006/0230674 A1 * 10/2006 Marchildon ..... A01G 31/047 47/60
2008/0256844 A1 * 10/2008 Jones ..... C10L 1/003 44/275
2009/0235578 A1 * 9/2009 Nopper ..... C10L 5/361 44/590
2011/0047865 A1 * 3/2011 Park ..... C10L 5/365 44/535
2013/0089747 A1 * 4/2013 Allen, Jr. ..... A61L 15/34 428/484.1
2014/0199646 A1 * 7/2014 Beadles ..... C11C 5/002 431/288
2015/0233022 A1 * 8/2015 McCullough ..... D01F 8/02 428/221

FOREIGN PATENT DOCUMENTS

DE 202016102694 U1 * 6/2016 ..... C10L 11/04

* cited by examiner

*Primary Examiner* — Pamela H Weiss
(74) *Attorney, Agent, or Firm* — Lee & Hayes, PLLC

(57) ABSTRACT

Fire enhancement devices and methods for manufacturing and using the same are disclosed. The fire enhancement devices may include wax, cotton fibers, cotton seeds, ground cotton plant material, gum resin, and/or a wick. The fire enhancement devices may be manufactured by placing one or more layers of cotton fibers and cotton seeds, pouring a mixture of the cotton plant material and gum resin over at least one of the layers, pouring melted wax over the layers, and adding a wick.

20 Claims, 4 Drawing Sheets

FIRE ENHANCEMENT DEVICE

BACKGROUND

Starting a fire typically requires kindling, pieces of wood, an ignition source such as a match, and an accelerant such as gasoline, kerosene, or an easily-ignitable substance such as newspaper. It can be difficult to start a fire or keep a fire burning without kindling and/or the accelerant. In other words, placing a match on a large piece of wood is very unlikely to cause the piece of wood to catch fire. As such, people that desire to start a fire must purchase, store, use, and in some cases, carry kindling and accelerant. The present innovation provides a solution to this problem with a fire enhancement device that does not require kindling or an accelerant to start and/or maintain a fire.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference numbers in different figures indicates similar or identical items. The environments and devices depicted in the accompanying figures are not to scale and components within the figures may be depicted not to scale with each other.

DETAILED DESCRIPTION

Figure 1:
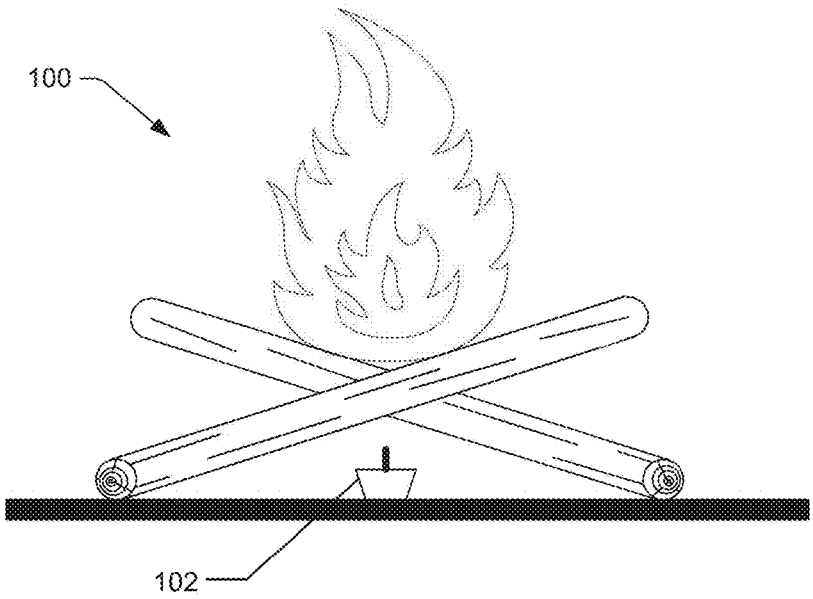
FIG. 1 illustrates a schematic diagram of an example environment in which a fire enhancement device may be utilized.

Fire enhancement devices and methods for manufacturing and using fire enhancement devices are described herein. Take, for example, a person seeking to camp in the woods at a location remote from that person's home. The camper may bring a host of equipment to make the camping trip enjoyable. However, generally, the camper has a limited amount of space in his or her vehicle and/or backpack and must decide which items to bring on the trip and which items to leave behind. Generating a fire is typically desired on a camping trip, and as described above, to start a fire that camper will likely pack an ignition source, such as a match or a lighter, kindling, and an accelerant. The kindling may include a bundle of small sticks and branches that may be ignited more easily than larger pieces of wood. The accelerant may include a container of flammable liquid, such as gasoline and/or kerosene, and/or an easily-ignitable substance such as newspaper, paper towels, and/or napkins, for example. Not only does the kindling and accelerant take up valuable space, this equipment will only be useful to start a fire in ideal conditions. If the camper desires to build a fire while it is raining and/or if it has been raining and the wood to be used is wet or damp, the kindling and accelerant will likely not be enough to start and/or maintain a fire. It should be noted that while several examples used herein are related to utilization of the disclosed devices for camping, camping is but one illustrative situation where the devices may be utilized. The devices may be utilized in any situation where a user desires to start and/or maintain a fire.

To solve the problems described in the above example, the innovation disclosed herein provides a light weight, easy to use, long lasting, inexpensive, and compact fire enhancement device that can be used to successfully start a fire in ideal or less-than-ideal conditions. The fire enhancement device may resemble a candle and may fit in the palm of a user's hand and may weigh very little, such as less than a few ounces. Additionally, as little as one of the disclosed fire enhancement devices may burn hot enough and long enough to start and/or maintain a fire, even when it has rained and/or is currently raining. Additionally, the fire enhancement device may be utilized by simply lighting a wick, similar to how a person would light the wick of a candle. The fire enhancement device may contain no harmful chemicals and may provide for a safer form of accelerant than, for example, gasoline and/or kerosene.

The fire enhancement devices described herein may include cotton fibers, cotton seeds, cotton plant material, gum resin, wax, and/or a wick. When these materials are combined as described herein, the fire enhancement devices may burn at a high temperature and for several minutes with a large flame that can ignite medium to large pieces of wood. By way of example, a candle will burn at a temperature at or less than 250° Fahrenheit. The fire enhancement devices described herein burn at a range of about 400° Fahrenheit to about 850° Fahrenheit, leading at least in part to the functional benefits described herein. These temperatures may be maintained from about 20 minutes to about 30 minutes, which allows for high temperature burning for a long period of time. The cotton fibers may be from a classification of cotton boll described as educational cotton bolls. Cotton seeds may be contained within the cotton fibers. Those cotton seeds may be at least partially crushed such that the shells of the cotton seeds are at least cracked. The cotton plant material may include components of a cotton plant other than cotton fibers and cotton seeds. For example, the cotton plant material may include cotton branches, cotton leaves, cotton burrs, cotton stems, and/or cotton roots. The cotton plant material may be ground into a coarse or fine powder. The gum resin may also be ground into a coarse or fine powder.

The fire enhancement devices may be sized similar to, for example, a votive candle and may have two layers of cotton fibers and cotton seeds. One of the layers, such as the bottom-most layer, may also contain a mixture of the ground cotton plant material and the ground gum resin. Wax may be incorporated through the layers of cotton fibers and cotton seeds and may be dispersed throughout the mixture of ground cotton plant material and ground gum resin. A wick may be disposed such that a portion of the wick extends through at least a portion of the device while another portion of the wick extends from the device. The portion of the wick that extends from the device may allow a person to ignite the wick. As the wax surrounding the wick melts and/or as the wick itself burns, the wax dispersed throughout the layers of the device, as described above, may also start to melt and/or burn. As the cotton fibers are ignited, the burning cotton fibers may produce a greater amount of heat and/or flame than the melting and/or burning of the wax. This heat and/or flame may be further intensified by the ignition and burning of the cotton seeds. As the ground plant material is ignited, the heat and/or flame may be further intensified while the ground gum resin may enhance the length of heat and/or flame put off by the fire enhancement device.

It should be understood that while the examples used herein describe a camper utilizing the fire enhancement devices, additional uses of the fire enhancement devices other than in camping situations are included in this disclosure. For example, the fire enhancement device described herein may be used to start and/or maintain a fire in any situation where it is desirable to start and/or maintain a fire.

In addition to the fire enhancement devices described herein, the present disclosure includes methods of manufacturing fire enhancement devices, such as the fire enhancement devices described herein. The manufacturing method may include, for example, placing a first layer of cotton fibers and cotton seeds into a mold. Then, a mixture of cotton plant material and gum resin may be placed in the mold. At least a portion of the mixture may fall through and/or around the cotton fibers and seeds. Then, a second layer of cotton fibers and cotton seeds may be placed in the mold and melted wax may be poured into the mold. The melted wax may flow through the various layers of material and may fill in spaces between the layers and/or between materials of the layers. A wick may be placed into the wax such that a portion of the wick extends through the fire enhancement device while another portion of the wick extends above the wax. The mold may be cooled, such as to freezing temperatures, to allow the wax to solidify and to promote a clean, durable end product.

As described herein, the fire enhancement devices may include various components of the cotton plant. These cotton components may increase the amount of flame given off by the device and/or may increase the temperature of the heat given off by the device. These features provide a benefit in the application of starting and/or maintaining a fire. However, these features are generally not beneficial in, for example, the application of a candle, where increased heat and/or flame may be dangerous and/or result in a candle that burns quicker than desirable.

The present disclosure provides an overall understanding of the principles of the structure, function, manufacture, and use of the devices and methods disclosed herein. One or more examples of the present disclosure are illustrated in the accompanying drawings. Those of ordinary skill in the art will understand that the devices and methods specifically described herein and illustrated in the accompanying drawings are non-limiting embodiments. The features illustrated or described in connection with one embodiment may be combined with the features of other embodiments, including as between devices and methods. Such modifications and variations are intended to be included within the scope of the appended claims.

Additional details are described below with reference to several example embodiments.

FIG. 1 illustrates a schematic diagram of an example environment 100 in which a fire enhancement device 102 may be utilized. This example environment 100 includes two pieces of wood that have been placed on a surface, such as the ground. The example environment 100 roughly approximately an area for building a fire. While the example used throughout this disclosure is that of a campfire, it should be understood that any setting in which a fire is desired could be used as the example environment 100. In use, the fire enhancement device 102 may be placed beneath at least one piece of wood. Before or after placement of the fire enhancement device 102, a wick of the device 102 may be lit, such as by a match or lighter. Once lit, the wick may burn, the wax of the device 102 may begin to melt, and the cotton fibers, seeds, and plant material may begin to burn. The corresponding flame and heated air produced by the burning cotton components and/or the wax may contact the pieces of wood and, after some time, the pieces of wood may ignite and burn. Thereafter, additional pieces of wood may be placed on the fire to keep the fire from terminating. In some examples, only one fire enhancement device 102 may be used to start a fire. In other examples, multiple fire enhancement devices 102 may be used.

Figure 2:
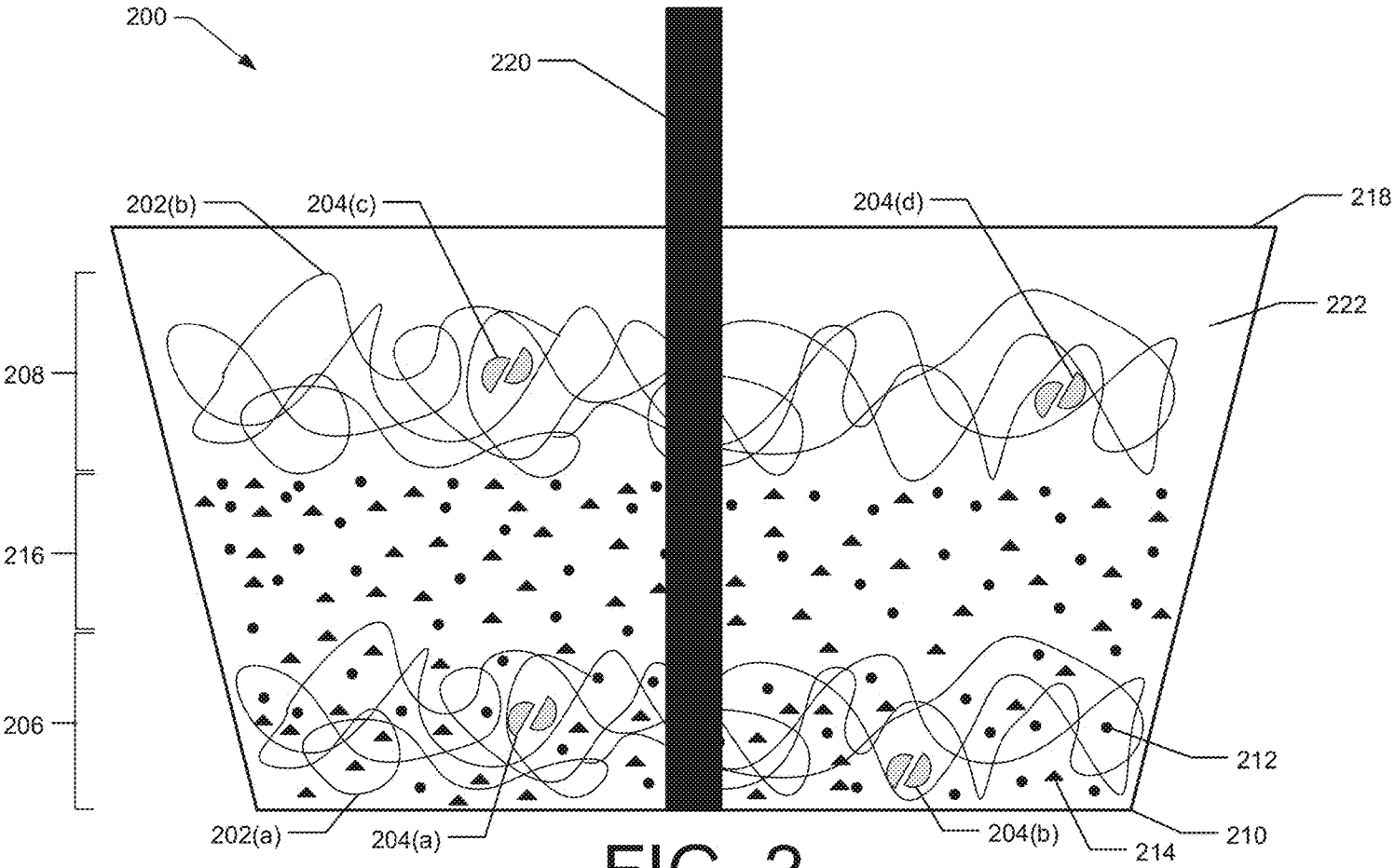
FIG. 2 illustrates a cross-sectional schematic diagram of an example fire enhancement device.

FIG. 2 illustrates a cross-sectional schematic diagram of an example fire enhancement device 200. The device 200 may be sized similar to the size of a votive candle, in some examples. For example, the device 200 may be less than 5 inches wide, less than 4 inches wide, less than 3 inches wide, less than 2 inches wide, or less than 1 inch wide. The device 200 may be less than 5 inches high, less than 4 inches high, less than 3 inches high, less than 2 inches high, or less than 1 inch high, for example. The device 200 may have a conical shape, a cylindrical shape, a cubic shape, or a triangular shape, for example. The device 200 may be composed of one or more of the following materials: wax, cotton fibers, cotton seeds, cotton plant material other than fibers and seeds, gum resin, and a wick. Each of these components and example arrangements of these components are described below.

The cotton fibers 202(*a*) and 202(*b*) and cotton seeds 204(*a*)-(*d*) may be disposed in layers of the device 200. For example, a first layer 206 of the device 200 may include cotton fibers 202(*a*) and cotton seeds 204(*a*)-(*b*). A second layer 208 of the device 200 may include cotton fibers 202(*b*) and cotton seeds 204(*c*)-(*d*). The first layer 206 may be disposed at or near a bottom end 210 of the device 200. The bottom end 210 may be defined as the portion of the device 200 that, when in use, would contact the ground or other surface on which the pieces of wood may rest. The first layer 206 may have a volume of approximately one-third of the device 200. In other examples, the first layer 206 may have a volume of less than one-third of the device 200 or more than one-third of the device 200. The cotton fibers 202(*a*) may be loose fibers such that the fibers may be manipulated, or the cotton fibers 202(*a*) may be compacted such that the fibers are pressed into a form. The cotton fibers 202(*a*) may be fibers from a boll of a cotton plant. The quality of the boll may be, for example, a premium boll, a high-quality boll, or an educational boll. Additionally, or alternatively, the cotton fibers 202(*a*) may be from a singular boll or from more than one boll. In some examples, the cotton fibers 202(*a*) may be synthetic fibers that have the same or similar physical properties to cotton. For example, the synthetic fibers may be composed of polyester, polypropylene, and/or nylon.

The cotton seeds 204(*a*)-(*b*) may be at least partially crushed, as depicted in FIG. 2. The cotton seeds 204(*a*)-(*b*) may be crushed into various pieces, as depicted in FIG. 2, or the cotton seeds 204(*a*)-(*b*) may be cracked such that a shell of the seed is split at least partially but the cotton seeds 204(*a*)-(*b*) have not split into various pieces. The cotton seeds 204(*a*)-(*b*) may be uniform in the amount of crushing or the cotton seeds 204(*a*)-(*b*) may have varying amounts of crushing. In examples, the first layer 206 may not include a cotton seed. In other examples, the first layer 206 may include one cotton seed 204(*a*), at least two cotton seeds 204(*a*)-(*b*), at least three cotton seeds, at least four cotton seeds, at least five cotton seeds, or more than five cotton seeds. In other examples, the first layer 206 may have a range of cotton seeds, such as from one to three cotton seeds, from one to four cotton seeds, from two to four cotton seeds, from one to five cotton seeds, from two to five cotton seeds, or from three to five cotton seeds.

The first layer 206 may additionally include cotton plant materials 212 other than cotton fibers and cotton seeds. For example, cotton plant materials 212 may include cotton stems, cotton branches, cotton burrs, cotton leaves, and/or cotton roots. The cotton plant materials 212 may be, in examples, ground into a coarse or fine powder. The cotton plant materials 212 are shown in FIG. 2 as having a roughly circular shape. However, the shape used to depict the ground cotton plant materials 212 is by way of illustration only and is used herein to differentiate the cotton plant materials 212 from other ground up components, described below. It should be understood that the cotton plant materials 212 may be in any shape and may varying in size and dimension from millimeter sizes to micrometer and/or nanometer sizes.

The first layer 206 may additionally include gum resin 214. The gum resin 214 may be described as mastic gum, mastic, Arabic gum, Yemen gum, plant resin, tears of Chios, and/or mastic tree sap. The gum resin 214 may be particulate size, such as shown in FIG. 2. In examples, the gum resin 214 may be ground into a coarse or fine powder, which may be similar to the sizes and/or dimensional of the cotton plant materials 212, as described above. In examples, the ground cotton plant materials 212 and the ground gum resin 214 may be mixed together or otherwise combined. In these examples, the process of mixing the cotton plant materials 212 with the gum resin 214 may cause at least a portion of the gum resin 214 to adhere to at least a portion of the cotton plant materials 212. This mixture, or a portion thereof, may be poured over the first layer 206 and in so doing at least a portion of the mixture may fall through and/or be captured in the first layer 206. A portion of the mixture may adhere to the cotton fibers 202(*a*) and/or the cotton seeds 204(*a*)-(*b*).

In examples, the mixture of the cotton plant materials 212 and the gum resin 214 may be added in an amount that covers the top of the first layer 206 or that extends beyond the top of the first layer 206. In this example, a third layer 216 of the device 200 may comprise a layer of the mixture of the cotton plant material 212 and the gum resin 214 without cotton fibers or cotton seeds. The ratio of cotton plant materials 212 to gum resin 214 may be, for example, about 1:1, or about 1:1.1, or about 1:1.2, or about 1:1.3, or about 1:1.4, or about 1:1.5.

The second layer 208 of the device 200 may have the same or similar components as described with respect to the first layer 206. For example, the second layer 208 may include cotton fibers 202(*b*) and/or cotton seeds 204(*c*)-(*d*). The second layer 208 may be disposed at or near a top end 218 of the device 200. The top end 218 may be defined as the portion of the device 200 that has a wick 220 extending from the device 200. The second layer 208 may have a volume of approximately one-third of the device 200. In other examples, the second layer 208 may have a volume of less than one-third of the device 200 or more than one-third of the device 200. The cotton fibers 202(*b*) may be loose fibers such that the fibers may be manipulated, or the cotton fibers 202(*b*) may be compacted such that the fibers are pressed into a form. The cotton fibers 202(*b*) may be fibers from a boll of a cotton plant. The quality of the boll may be, for example, a premium boll, a high-quality boll, or an educational boll. Additionally, or alternatively, the cotton fibers 202(*b*) may be from a singular boll or from more than one boll. In some examples, the cotton fibers 202(*b*) may be synthetic fibers that have the same or similar physical properties to cotton. For example, the synthetic fibers may be composed of polyester, polypropylene, and/or nylon.

The cotton seeds 204(*c*)-(*d*) may be at least partially crushed, as depicted in FIG. 2. The cotton seeds 204(*c*)-(*d*) may be crushed into various pieces, as depicted in FIG. 2, or the cotton seeds 204(*c*)-(*d*) may be cracked such that a shell of the seed is split at least partially but the cotton seeds 204(*c*)-(*d*) have not split into various pieces. The cotton seeds 204(*c*)-(*d*) may be uniform in the amount of crushing or the cotton seeds 204(*c*)-(*d*) may have varying amounts of crushing. In examples, the second layer 208 may not include a cotton seed. In other examples, the second layer 208 may include one cotton seed 204(*c*), at least two cotton seeds 204(*c*)-(*d*), at least three cotton seeds, at least four cotton seeds, at least five cotton seeds, or more than five cotton seeds. In other examples, the second layer 208 may have a range of cotton seeds, such as from one to three cotton seeds, from one to four cotton seeds, from two to four cotton seeds, from one to five cotton seeds, from two to five cotton seeds, or from three to five cotton seeds. In examples, the second layer 208 may not include cotton plant material 212 and/or gum resin 214. In other examples, the second layer 208 may include cotton plant material 212 and/or gum resin 214.

It should be understood that while two layers of cotton fibers and cottons seeds are described herein by way of example, the fire enhancement device may include just one layer or may include more than two layers.

The device 200 may also include wax 222. The wax 222 may be, for example, composed of soy. The wax 222 may additionally, or alternatively, be composed of beeswax and/or paraffin wax. The wax 222 may be melted and poured over the second layer 208 of the device 200. The melted wax 222 may disperse through and throughout the second layer 208, through and throughout the third layer 216, and through and throughout the first layer 206 such that substantially all of the free or open space in the first layer 206, second layer 208, and/or third layer 216 is filled with the melted wax 222. In examples, the wax 222, when it comes into contact with the gum resin 214 may cause the gum resin 214 to at least partially melt or liquefy. This may further cause the gum resin 214 and/or the cotton plant materials 212 to be dispersed into the first layer 206. An amount of wax 222 may be added until, for example, the second layer 208 is covered by the wax 222. Additional wax 222 may be added over top of the second layer 208 such that a layer of just wax 222 is formed on the top end 218 of the device 200. In examples, the wax 222 may already be colored, either naturally or through an additive. In other examples, one or more colorants may be added to the wax 222 to create a device 200 with a specific color, which may assist with aesthetics and/or functionality of the device 200. Additionally, or alternatively, one or more additives may be added to the wax 222 to control the burn rate of the wax 222. These additives may include, for example, stearic acid, palm stearic, Micro 180, vybar 103, and/or vybar 260. In examples, the wax 222 to cotton plant material 212 may be about 4:2.5, or about 4:2, or about 4:3.

The device 200 may also include a wick 220. The wick 220 may be coated, at least in part, with a coating, such as a wax that assists with controlling the burn rate of the wick 220. The wick 220 may extend into and/or through the first layer 206, the second layer 208, and/or the third layer 216. A portion of the wick 220 may extend outward from the device 200 and through the top end 218. This portion of the wick 220 may be used to start burning the device 200. In examples, the device 200 may not include a wick 220. In these examples, the device 200 may be utilized as a fire "booster" or otherwise may be utilized to maintain a fire. For example, in instances where a device 200 with a wick 220 was utilized to start a fire and/or when a fire has already been started, a device 200 without a wick 220 may be utilized to maintain the fire.

Figure 3:
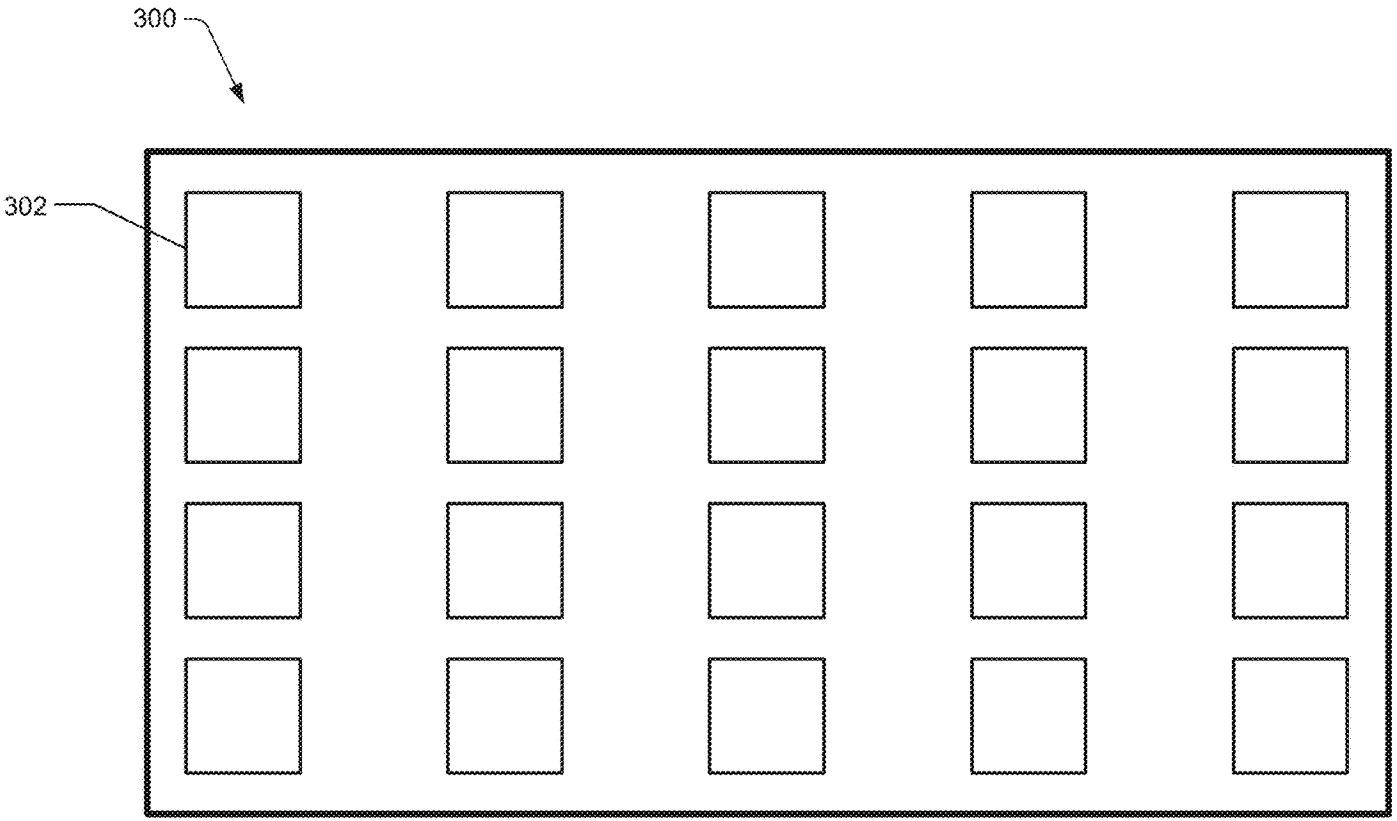
FIG. 3 illustrates an example mold used in the manufacture of fire enhancement devices.

FIG. 3 illustrates an example mold 300, from a top perspective, used in the manufacture of fire enhancement devices. The mold 300 includes one or more indents 302, which may receive the components of the fire enhancement devices, such as the components described above. The indents 302 shown in FIG. 3 are rectangular in shape. However, it should be understood that the indents 302 may have circular, oval, triangular, or other cubic shapes. Additionally, or alternatively, the indents 302 may all have the same size and/or shape or the sizes and/or shapes of the various indents 302 may vary. For example, a first indent 302 may be larger or smaller than one or more other indents 302 of the mold 300. Additionally, or alternatively, the first indent 302 may have a different shape than the one or more other indents 302 of the mold 300. The number of indents 302 may also vary. As shown in FIG. 3, the mold 300 includes 20 indents 302. However, it should be understood that the mold 300 may include one indent 302 or more than one indent 302. The mold 300 may be composed of a metal, polymeric material, or a combination thereof.

Figure 4:
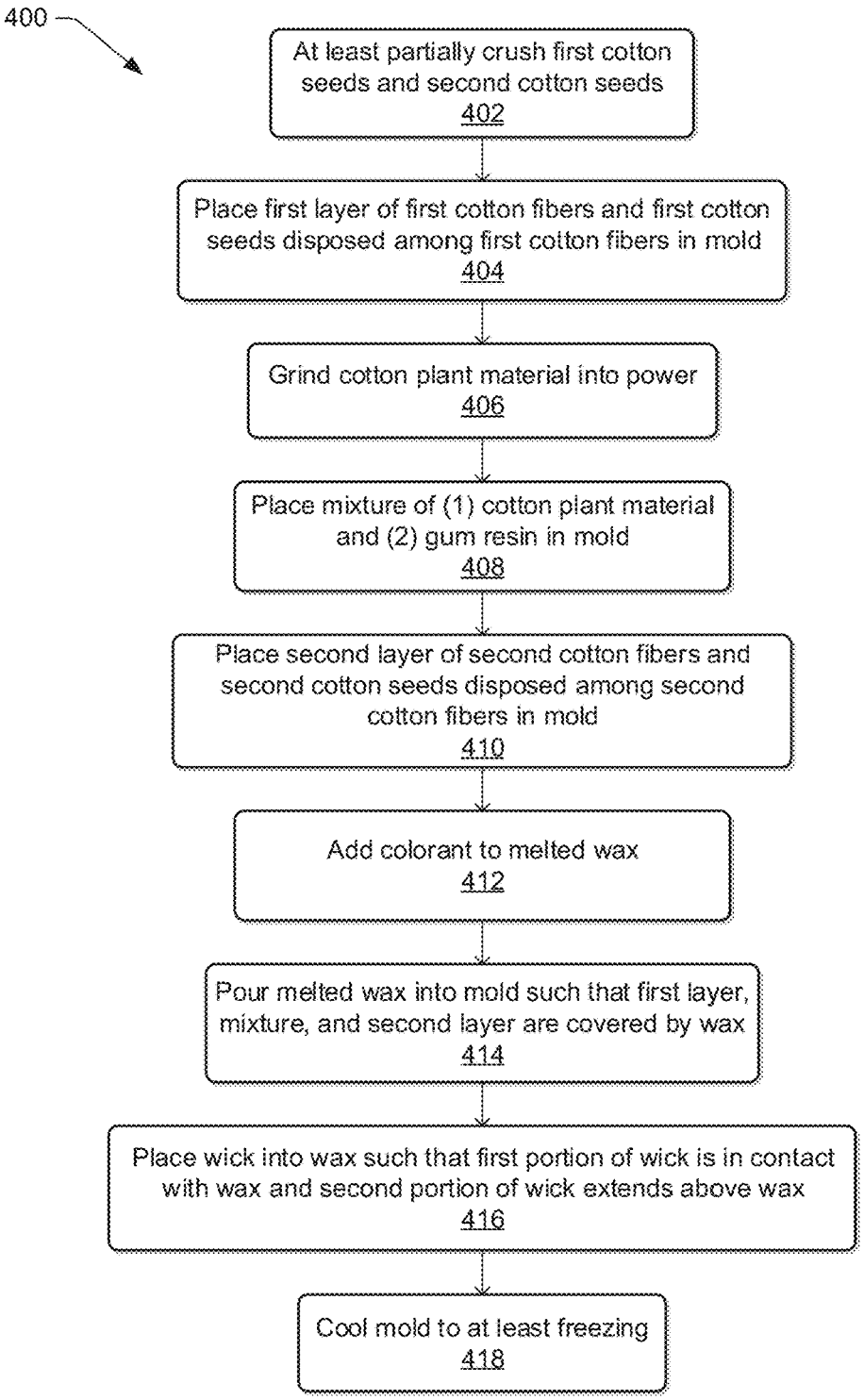
FIG. 4 illustrates a flow diagram of an example process for manufacturing fire enhancement devices.

FIG. 4 illustrates an example process 400 for manufacturing fire enhancement devices, such as those described above. The processes and operations described herein are illustrated as collections of blocks in logical flow diagrams, which represent a sequence of operations. The operations may be performed by a human or group of humans and/or some or all of the operations may be performed by software. In the context of software, the blocks may represent computer-executable instructions stored on one or more computer-readable media that, when executed by one or more processors, program the processors to perform the recited operations. Generally, computer-executable instructions include routines, programs, objects, components, data structures and the like that perform particular functions or implement particular data types. Any number of the described blocks may be combined in any order and/or in parallel to implement the process, or alternative processes, and not all of the blocks need be executed. For discussion purposes, the processes are described with reference to the environments, architectures, and devices described in the examples herein, such as, for example those described with respect to FIGS. 1-3, although the processes may be implemented in a wide variety of other environments, architectures and devices.

FIG. 4 illustrates a flow diagram of an example process 400 for manufacturing fire enhancement devices. The order in which the operations or steps are described is not intended to be construed as a limitation, unless otherwise stated, and any number of the described operations may be combined in any order and/or in parallel to implement process 400 unless otherwise stated.

At block 402, process 400 may include at least partially crushing first cotton seeds and second cotton seeds. For example, as described above, one or more layers of cotton fibers may be present in the fire enhancement device. The cotton fibers may have one or more seeds dispersed among the cotton fibers. In these examples, the cotton fibers and cotton seeds may be put under pressure at least until at least some of the cotton seeds crack. For example, a portion of cotton fiber and cotton seeds may be hit, such as with a hammer or other device that can deliver force to the cotton seeds. The force of the hitting device may cause the cotton seeds to crack and/or break apart into various pieces. Additionally, or alternatively, the portion of cotton fiber and cotton seeds may be rolled, such as through a press or with a rolling pin, which may cause the cotton seeds to crack and/or break apart into various pieces. In other examples, the cotton fibers and the cotton seeds may be separate components, such as when a synthetic fiber is used in place of or in addition to the cotton fibers. In this example, the cotton seeds may be crushed without the cotton fibers. The amount of crushing of the cotton seeds may vary. In examples, the crushing may only result in the cracking of the shells of the cotton seeds. In other examples, the crushing may result in the cotton seeds breaking apart. In still other examples, the crushing may result in the cotton seeds being crushed into a coarse or fine powder.

At block 404, the process 400 may include placing a first layer of first cotton fibers and first cotton seeds disposed among the first cotton fibers in a mold, such as the mold 300 from FIG. 3. The first layer may be disposed at or near a bottom end of the mold. The first layer may have a volume of approximately one-third of the mold. In other examples, the first layer may have a volume of less than one-third of the mold or more than one-third of the mold. The cotton fibers may be loose fibers such that the fibers may be manipulated, or the cotton fibers may be compacted such that the fibers are pressed into a form. The cotton fibers may be fibers from a boll of a cotton plant. The quality of the boll may be, for example, a premium boll, a high-quality boll, or an educational boll. Additionally, or alternatively, the cotton fibers may be from a singular boll or from more than one boll. In some examples, the cotton fibers may be synthetic fibers that have the same or similar physical properties to cotton. For example, the synthetic fibers may be composed of polyester, polypropylene, and/or nylon.

The cotton seeds may be at least partially crushed, as described above with respect to block 402. In examples, the first layer may not include a cotton seed. In other examples, the first layer may include one cotton seed, at least two cotton seeds, at least three cotton seeds, at least four cotton seeds, at least five cotton seeds, or more than five cotton seeds. In other examples, the first layer may have a range of cotton seeds, such as from one to three cotton seeds, from one to four cotton seeds, from two to four cotton seeds, from one to five cotton seeds, from two to five cotton seeds, or from three to five cotton seeds.

Placement of the first layer of the cotton fibers and the cotton seeds may be performed by a person or group of people, or by a machine where a processor executing instructions stored in computer-readable media may cause the machine to place the first layer. Additional operations such as the separation of the cotton fibers and the cotton seeds from a larger boll of cotton or container of cotton may be performed. The amount of cotton fibers and/or cotton seeds to be used may depend on the size and/or shape of the mold and may be determined from, for example, determining a desired volume and/or mass of cotton fibers and/or cotton seeds. In some examples, placement of the first layer of the cotton fibers and the cotton seeds may include placing loose cotton fibers and cotton seeds in the mold. In other examples, placement of the first layer may include placing compressed cotton fibers and cotton seeds in the mold. In still other examples, placement of the first layer may include placing loose cotton fibers and cotton seeds in the mold and then applying force to the cotton fibers such that the fibers are compressed.

At block 406, the process 400 may include grinding cotton plant material into a powder. In examples, the cotton plant material may include one or more components of a cotton plant other than cotton fibers and cotton seeds. For example, cotton plant materials may include cotton stems, cotton branches, cotton burrs, cotton leaves, and/or cotton roots. The cotton plant materials may be, in examples, ground into a coarse or fine powder. It should be understood that the cotton plant materials may be in any shape and may vary in size and dimension from millimeter sizes to micrometer and/or nanometer sizes. Grinding of the cotton plant materials may include crushing, chopping, slicing, and/or grinding the cotton plant material until a desired particle size is achieved. It should be understood that while the cotton plant material is described herein as components of the cotton plant other than cotton fibers and cotton seeds, a small amount of cotton fibers and/or cotton seeds may be present. For example, when cotton fibers are pulled from a burr, a small amount of cotton fibers may remain on the burr and may be grinded along with the burr and/or other components of the cotton plant to arrive at the ground cotton plant material.

At block 408, the process 400 may include placing a mixture of (1) the cotton plant material and (2) gum resin in the mold. The cotton plant material may be the ground cotton plant material as described with respect to block 406. Additionally, or alternatively, the cotton plant material may be unground cotton plant material and/or cotton plant material that was previously ground. The gum resin may be particulate sized. In examples, the gum resin may be ground into a coarse or fine powder, which may be similar to the sizes and/or dimensional of the cotton plant materials, as described above. In examples, the ground cotton plant materials and the ground gum resin may be mixed together or otherwise combined. In these examples, the process of mixing the cotton plant materials with the gum resin may cause at least a portion of the gum resin to adhere to at least a portion of the cotton plant materials. This mixture, or a portion thereof, may be poured over the first layer and in so doing at least a portion of the mixture may fall through and/or be captured in the first layer. A portion of the mixture may adhere to the cotton fibers and/or the cotton seeds. The gum resin may be described as mastic gum, mastic, Arabic gum, Yemen gum, plant resin, tears of Chios, and/or mastic tree sap.

In examples, the mixture of the cotton plant materials and the gum resin may be added in an amount that covers the top of the first layer or that extends beyond the top of the first layer. In this example, another layer of the fire enhancement device may comprise a layer of the mixture of the cotton plant material and the gum resin without cotton fibers or cotton seeds. The ratio of cotton plant materials to gum resin may be, for example, about 1:1, or about 1:1.1, or about 1:1.2, or about 1:1.3, or about 1:1.4, or about 1:1.5.

Placement of the mixture of the cotton plant material and the gum resin may be performed by a person or group of people, or by a machine where a processor executing instructions stored in computer-readable media may cause the machine to place the mixture. The amount of mixture to be placed in the mold may depend on the size and shape of the mold and/or the level of compaction of the cotton fibers from the first layer and/or a desired thickness of the other layer that is composed of the mixture without the cotton fibers and/or cotton seeds. The amount of the mixture to be used may be determined from the desired volume of the mixture and/or the desired weight or mass of the mixture. When placement of the mixture is performed by a machine, the machine may be programmed to release a certain amount of the mixture and/or to allow the mixture to flow from the machine to the mold for a certain amount of time.

At block 410, the process 400 may include placing a second layer of second cotton fibers and second cotton seeds disposed among the second cotton fibers in the mold, such as the mold 300 from FIG. 3. The second layer may be disposed at or near a top end of the mold. The second layer may have a volume of approximately one-third of the mold. In other examples, the second layer may have a volume of less than one-third of the mold or more than one-third of the mold. The cotton fibers may be loose fibers such that the fibers may be manipulated, or the cotton fibers may be compacted such that the fibers are pressed into a form. The cotton fibers may be fibers from a boll of a cotton plant. The quality of the boll may be, for example, a premium boll, a high-quality boll, or an educational boll. Additionally, or alternatively, the cotton fibers may be from a singular boll or from more than one boll. In some examples, the cotton fibers may be synthetic fibers that have the same or similar physical properties to cotton. For example, the synthetic fibers may be composed of polyester, polypropylene, and/or nylon.

The cotton seeds may be at least partially crushed, as described above with respect to block 402. In examples, the second layer may not include a cotton seed. In other examples, the second layer may include one cotton seed, at least two cotton seeds, at least three cotton seeds, at least four cotton seeds, at least five cotton seeds, or more than five cotton seeds. In other examples, the second layer may have a range of cotton seeds, such as from one to three cotton seeds, from one to four cotton seeds, from two to four cotton seeds, from one to five cotton seeds, from two to five cotton seeds, or from three to five cotton seeds.

Placement of the second layer of the cotton fibers and the cotton seeds may be performed by a person or group of people, or by a machine where a processor executing instructions stored in computer-readable media may cause the machine to place the second layer. Additional operations such as the separation of the cotton fibers and the cotton seeds from a larger boll of cotton or container of cotton may be performed. The amount of cotton fibers and/or cotton seeds to be used may depend on the size and/or shape of the mold and may be determined from, for example, determining a desired volume and/or mass of cotton fibers and/or cotton seeds. In some examples, placement of the second layer of the cotton fibers and the cotton seeds may include placing loose cotton fibers and cotton seeds in the mold. In other examples, placement of the second layer may include placing compressed cotton fibers and cotton seeds in the mold. In still other examples, placement of the second layer may include placing loose cotton fibers and cotton seeds in the mold and then applying force to the cotton fibers such that the fibers are compressed.

It should be understood that while two layers of cotton fibers and cottons seeds are described herein by way of example, the fire enhancement device may include just one layer or may include more than two layers.

At block 412, the process 400 may include adding a colorant to melted wax. In examples, one or more colorants may be added to the wax to create a fire enhancement device with a specific color, which may assist with aesthetics and/or functionality of the device. Additionally, or alternatively, one or more additives may be added to the wax to control the burn rate of the wax. These additives may include, for example, stearic acid, palm stearic, Micro 180, vybar 103, and/or vybar 260.

At block 414, the process 400 may include pouring the melted wax into the mold such that the first layer, the mixture, and the second layer are covered by the wax. The wax may be, for example, composed of soy. The wax may additionally, or alternatively, be composed of beeswax and/or paraffin wax. The wax may be melted and poured over the second layer of the fire enhancement device. The melted wax may disperse through the second layer, through the layer composed of the mixture of cotton plant material and gum resin without cotton fibers or seeds, if present, and through the first layer such that substantially all of the free or open space in the first layer, second layer, and mixture layer, if present, is filled with the melted wax. In examples, the wax, when it comes into contact with the gum resin may cause the gum resin to at least partially melt or liquefy. This may further cause the gum resin and/or the cotton plant materials to be dispersed into the first layer. An amount of wax may be added until, for example, the second layer is covered by the wax. Additional wax may be added over top of the second layer such that a layer of just wax is formed on the top end of the fire enhancement device.

Pouring of the melted wax may be performed by a person or group of people, or by a machine where a processor executing instructions stored in computer-readable media may cause the machine to pour the wax. Additional operations such as the melting of the wax, the weighing and/or volumetric measurement of the wax, and/or the grinding and/or cutting of the wax may be performed. The amount of wax to be used may depend on the size and/or shape of the mold and may be determined from, for example, determining a desired volume and/or mass of wax.

At block 416, the process 400 may include placing a wick into the wax such that a first portion of the wick is in contact with the wax and a second portion of the wick extends above the wax. The wick may be coated, at least in part, with a coating, such as a wax that assists with controlling the burn rate of the wick. The wick may extend into and/or through the first layer, the second layer, and/or the layer composed of the mixture of the cotton plant material and the gum resin. A portion of the wick may extend outward from the device and through the top end. This portion of the wick may be used to start burning the device.

Placement of the wick may be performed by a person or group of people, or by a machine where a processor executing instructions stored in computer-readable media may cause the machine to place the wick. Additional operations such as the cutting of the wick to a size appropriate for the device may be performed. While the examples described herein describe the placement of a single wick, it should be understood that more than one wick may be placed in the device. For example, in instances where the device is large, such as having a diameter and/or width of over five inches, two or more wicks may be utilized.

At block 418, the process 400 may include cooling the mold to at least freezing. The mold may be cooled, such as to freezing temperatures, to allow the wax to solidify and to promote a clean, durable end product. As used herein, freezing may correspond to a temperature of 32° Fahrenheit or lower, including equivalent metrics of temperature such as Celsius and/or Kalvin. In other examples, cooling the mold may include reducing the temperature of the environment in which the mold is present to below room temperature. Cooling, as used herein, may include flash freezing and other methods of reducing the temperature of the mold and/or the wax held by the mold. The mold may be cooled for a period of at least one minute, at least two minutes, at least three minutes, at least four minutes, at least five minutes, at least 10 minutes, at least 15 minutes, at least 20 minutes, at least 25 minutes, at least 30 minutes, or at least one hour. Once the wax has solidified, the fire enhancement devices may be removed from the mold and may be ready for use.

To use, an ignition source, such as a match and/or a lighter may be used to start burning the wick. Once lit, the wick will begin to burn and the wax surrounding the wick may begin to melt. As the wax surrounding the wick melts and/or as the wick itself burns, the wax dispersed throughout the layers of the device, as described above, may also start to melt and/or burn. As the cotton fibers are ignited, the burning cotton fibers may produce a greater amount of heat and/or flame than the melting and/or burning of the wax. This heat and/or flame may be further intensified by the ignition and burning of the cotton seeds. As the ground plant material is ignited, the heat and/or flame may be further intensified while the ground gum resin may enhance the length of time that heat and/or flame is put off by the fire enhancement device.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative of some embodiments that fall within the scope of the claims of the application.

What is claimed is:

1. A fire enhancement device, comprising:
cotton fibers from at least one educational cotton boll;
cotton seeds disposed within the cotton fibers;
a mixture of:
ground cotton plant material, the cotton plant material including cotton stems; and
ground gum resin;
soy wax dispersed throughout the cotton fibers and the mixture; and
a wick disposed such that a first portion of the wick is in contact with at least a portion of the soy wax and a second portion of the wick extends above the soy wax.

2. The device of claim 1, wherein the cotton seeds include two cotton seeds.

3. The device of claim 1, wherein the cotton seeds include three cotton seeds.

4. The device of claim 1, further comprising a colorant dispersed throughout at least a portion of the soy wax.

5. A device, comprising:
cotton fibers;
cotton seeds disposed within the cotton fibers;
a mixture of:
cotton plant material, the cotton plant material including cotton stems; and
gum resin; and
wax dispersed throughout the cotton fibers and the mixture.

6. The device of claim 5, wherein the wax includes soy wax.

7. The device of claim 5, wherein the cotton seeds include two cotton seeds.

8. The device of claim 5, wherein the cotton seeds include three cotton seeds.

9. The device of claim 5, wherein the cotton fibers are from at least one educational cotton boll.

10. The device of claim 5, wherein the cotton seeds are at least partially crushed.

11. The device of claim 5, wherein the cotton plant material includes ground cotton plant material.

12. The device of claim 5, further comprising a colorant dispersed throughout at least a portion of the wax.

13. A method of manufacturing a fire enhancement device, the method comprising:

placing a first layer of first cotton fibers and first cotton seeds disposed among the first cotton fibers in a mold;

placing a mixture of (1) cotton plant material and (2) gum resin in the mold;

placing a second layer of second cotton fibers and second cotton seeds disposed among the second cotton fibers in the mold;

pouring melted wax into the mold such that the first layer, the mixture, and the second layer are covered by the wax;

placing a wick into the wax such that a first portion of the wick is in contact with the wax and a second portion of the wick extends above the wax; and cooling the mold to at least freezing.

14. The method of claim 13, further comprising at least partially crushing the first cotton seeds and the second cotton seeds.

15. The method of claim 13, wherein the first cotton seeds include at least two cotton seeds and the second cotton seeds includes at least two cotton seeds.

16. The method of claim 13, further comprising grinding the cotton plant material into a powder.

17. The method of claim 13, wherein a ratio of cotton plant material to gum resin is from about 0.8:1 to about 0.8:1.5.

18. The method of claim 13, further comprising adding a colorant to the melted wax.

19. The method of claim 13, wherein the mold is cooled for at least 25 minutes.

20. The method of claim 13, wherein the wax includes soy wax.

* * * * *